US006539914B1

(12) United States Patent
Moser et al.

(10) Patent No.: US 6,539,914 B1
(45) Date of Patent: Apr. 1, 2003

(54) INTERNAL COMBUSTION ENGINE, A CONTROL ELEMENT FOR THE INTERNAL COMBUSTION ENGINE, AND METHOD FOR OPERATING THE INTERNAL COMBUSTION ENGINE

(75) Inventors: Winfried Moser, Ludwigsburg (DE); Matthias Philipp, Vaihingen/Enz (DE); Dirk Mentgen, Schwieberdingen (DE); Michael Oder, Illigen (DE); Georg Mallebrein, Korntal-Muenchingen (DE); Christian Koehler, Erligheim (DE); Juergen Foerster, Ingersheim (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 09/424,602

(22) PCT Filed: Mar. 24, 1999

(86) PCT No.: PCT/DE99/00873

§ 371 (c)(1),
(2), (4) Date: Feb. 7, 2000

(87) PCT Pub. No.: WO99/49194

PCT Pub. Date: Sep. 30, 1999

(30) Foreign Application Priority Data

Mar. 26, 1998 (DE) ..... 198 13 377

(51) Int. Cl.[7] ..... F02B 17/00
(52) U.S. Cl. ..... 123/295; 123/305
(58) Field of Search ..... 123/295, 305, 123/436, 294, 434

(56) References Cited

U.S. PATENT DOCUMENTS 6,050,232 A * 4/2000 Grob et al. ..... 123/179.16
6,089,206 A * 7/2000 Suzuki et al. ..... 123/295
6,148,790 A * 11/2000 Schulmeister ..... 123/295
6,446,596 B1 * 9/2002 Moser et al. ..... 123/295

* cited by examiner

*Primary Examiner*—Bibhu Mohanty
(74) *Attorney, Agent, or Firm*—Kenyon & Kenyon

(57) ABSTRACT

An internal combustion engine is provided with an injection valve with which fuel can be injected directly into a combustion chamber either during a compression phase in a first operating mode or during an intake phase in a second operating mode. In addition, a control unit is provided for shifting between the two operating modes and for differentiated control and/or regulation of the performance quantities that influence the actual torque of the internal combustion engine as a function of a setpoint torque in both operating modes. A change in the actual torque during a shifting operation is determined by the control unit, and at least one of the performance quantities is influenced by the control unit as a function thereof.

17 Claims, 6 Drawing Sheets

INTERNAL COMBUSTION ENGINE, A CONTROL ELEMENT FOR THE INTERNAL COMBUSTION ENGINE, AND METHOD FOR OPERATING THE INTERNAL COMBUSTION ENGINE

FIELD OF THE INVENTION

The present invention relates to a method of operating an internal combustion engine in a motor vehicle in particular, where fuel is injected directly into a combustion chamber either during a compression phase in a first operating mode or during an intake phase in a second operating mode, with shifting between the two operating modes, and where the performance quantities that influence the actual torque of the internal combustion engine are controlled and/or regulated differently as a function of a setpoint torque in both operating modes. In addition, the present invention relates to an internal combustion engine for a motor vehicle in particular having an injection valve with which fuel can be injected directly into a combustion chamber either during a compression phase in a first operating mode or during an intake phase in a second operating mode, and having a control unit for shifting between the two operating modes and for differentiated control and/or regulation of the performance quantities that influence the actual torque of the internal combustion engine as a function of a setpoint torque in both operating modes.

BACKGROUND INFORMATION

Systems for direct injection of fuel into the combustion chamber of an internal combustion engine are known in general. A distinction is made between stratified charge operation as the first operating mode and homogeneous operation as the second operating mode. Stratified charge operation is used in particular at low loads applied to the internal combustion engine, while homogeneous operation is used at higher loads.

In stratified charge operation, fuel is injected into the combustion chamber during the compression phase of the internal combustion engine in such a way that there is a cloud of fuel in the immediate vicinity of a sparkplug at the time of ignition. This injection can be accomplished in various ways. Thus, it is possible for the injected cloud of fuel to be near the sparkplug and to be ignited by it during or immediately after injection. It is likewise possible for the injected cloud of fuel to be guided to the sparkplug by a charge movement and only then ignited. In both combustion methods, there is a stratified charge but there is not a uniform distribution of fuel.

The advantage of stratified charge operation is that the smaller loads applied can then be carried out by the internal combustion engine with a very small quantity of fuel. However, larger loads cannot be handled by stratified charge operation.

In homogeneous operation which is provided for such larger loads, the fuel is injected during the intake phase of the internal combustion engine, so that turbulence can be created in the fuel, which is thus distributed readily in the combustion chamber. To this extent, homogeneous operation corresponds approximately to the operation of internal combustion engines where fuel is injected into the intake manifold in the traditional manner. Homogeneous operation can also be used with lower loads as needed.

In stratified charge operation, the throttle valve in the intake manifold leading to the combustion chamber is opened wide, and combustion is controlled and/or regulated essentially only by the fuel mass to be injected. In homogeneous operation, the throttle valve is opened and closed as a function of the torque required, and the fuel mass to be injected is controlled and/or regulated as a function of the intake air mass.

In both operating modes, i.e., in stratified charge operation and in homogeneous operation, the fuel mass to be injected is additionally controlled and/or regulated at an optimal level with regard to saving fuel, reducing exhaust and the like as a function of several additional performance quantities. The control and/or regulation is different in the two operating modes.

The internal combustion engine must be shifted from stratified charge operation to homogeneous operation and back again. In stratified charge operation, the throttle valve is opened wide, and thus the air is supplied largely unthrottled, but in homogeneous operation the throttle valve is only opened partially and thus reduces the supply of air. Especially in shifting from stratified charge operation to homogeneous operation, the ability of the intake manifold leading to the combustion chamber to store air must be taken into account. If this is not taken into account, shifting can lead to an increase in the torque delivered by the internal combustion engine.

SUMMARY OF THE INVENTION

The object of the present invention is to provide a method of operating an internal combustion engine with which improved shifting between the operating modes is possible.

The object is achieved with the method and internal combustion engine according to the present invention by determining a change in the actual torque during a shifting operation and by influencing at least one of the performance quantities as a function thereof.

On the basis of the determination of changes in the actual torque during the shifting operation, it is possible to detect irregular running or jerking during shifting. After jerking has been detected, irregular running can be counteracted by influencing performance quantities. It is thus possible on the whole to prevent irregular running or jerking when shifting from homogeneous operation to stratified charge operation or vice versa. Shifting operations between the two operating modes are thus improved in particular with regard to increased running smoothness and thus greater comfort.

It is also possible for the change in the actual torque to be determined as a function of the detected rpm of the internal combustion engine. This yields the result that with the help of the rpm sensor already provided, a change in the actual torque and thus jerking or the like can be detected. No additional sensors or other additional parts are necessary.

In a first embodiment of the present invention, an expected rpm is determined as a function of the setpoint torque, and the expected rpm is compared with the detected rpm of the internal combustion engine. Thus, an rpm prediction is made. The required rpm for no irregular running is calculated. Then a determination of whether or not jerking has occurred during the shifting operation is performed on the basis of a comparison of this expected rpm with the actual rpm of the internal combustion engine.

It is advantageous if at least one of the performance quantities of the internal combustion engine is influenced when the detected rpm differs from the expected rpm by more than a preselectable rpm difference. If the expected rpm differs significantly from the rpm actually detected, it is deduced from this that there has been irregular running during the shifting operation. This then results in the actual torque of the internal combustion engine being influenced by one of the performance quantities in the sense of a reduction in the change in rpm.

In addition, it is advantageous if no influence is implemented when several successive rpm differences have an approximately steady characteristic. If there is such an approximately steady characteristic, this means that the load applied to the internal combustion engine has changed. For example, because of an inclination or the like, i.e., a change in driving resistance, the torque has changed approximately steadily, i.e., it has increased, in this case. Thus, there is no jerking and no irregular running, so no countermeasures need be taken.

In a second embodiment of the present invention, at least two rpm gradients are determined from the detected rpm of the internal combustion engine, and two of the rpm gradients are compared. Thus, the change in the actual rpm of the internal combustion engine is monitored. This is accomplished easily by calculating the rpm gradients. No additional parts or the like are required.

It is advantageous if at least one of the performance quantities of the internal combustion engine is influenced when the two rpm gradients have a non-steady characteristic. The non-steady characteristic of the rpm gradients is thus interpreted as irregular running or jerking during the shifting operation. Load changes or the like result in an approximately steady characteristic of the rpm gradients, so no jerking is deduced in this case. Only when irregular running is detected are countermeasures taken to reduce the jerking during the shifting operation.

In another embodiment, the influence on one of the performance quantities is implemented adaptively. Thus, there is a permanent correction in the shifting operation. In this way it is possible to compensate for changes in the internal combustion engine over its lifetime, in particular wear phenomena and the like. It is also possible to compensate for deviations between different internal combustion engines of the same type in start up.

In another advantageous refinement of the present invention, the influence on one of the performance quantities is not implemented until the next shifting operation. This yields the result that the calculations according to the present invention can be performed between two shifting operations, so that sufficient time is available.

It is advantageous if the injected fuel mass is influenced in the sense of an increase in particular in the first operating mode. It is also advantageous if the firing angle or the firing time is influenced in the sense of a late adjustment in particular in the second operating mode. Through these measures, it is possible when irregular running is detected during the shifting operation to influence the actual torque of the internal combustion engine and thus reduce the irregular running. In particular, the two operating modes are approximated to one another at the shifting time through these measures.

The implementation of the method according to the present invention in the form of a control element which is provided for a control unit of an internal combustion engine in a motor vehicle in particular maybe important. A program capable of running on a computer, in particular on a microprocessor, and suitable for executing the method according to the present invention is stored on the control element. Thus, in this case, the present invention is implemented by a program stored on the control element, so that this control element together with the program represents the present invention in the same way as the method for whose execution the program is suitable. In particular an electronic storage medium, e.g., a read-only memory, may be used as the control element.

BRIEF DESCRIPTION OF THE DRAWINGS

FIG. 1 shows an internal combustion engine 1, with a piston 2 that can move back and forth in a cylinder 3. Cylinder 3 has a combustion chamber 4 connected to an intake manifold 6 and an exhaust pipe 7 via valves 5. In addition, an injection valve 8 controlled by a signal TI and a sparkplug 9 controlled by a signal ZW are also provided for combustion chamber 4.

Figure 1:
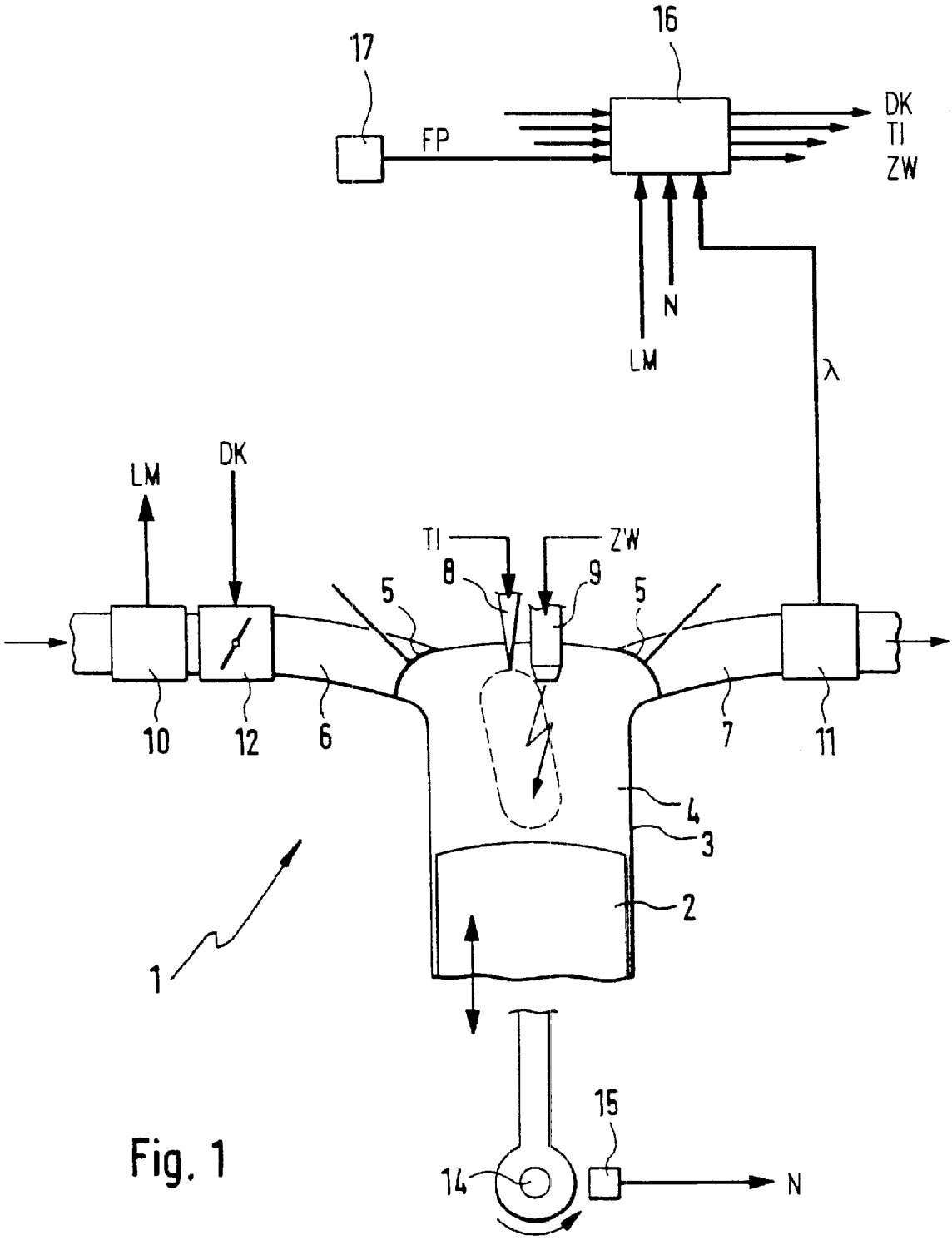
FIG. 1 shows a schematic block diagram of an embodiment of an internal combustion engine according to the present invention in a motor vehicle.

Intake manifold 6 is provided with an air flow sensor 10, and exhaust pipe 7 may be provided with a lambda sensor 11. Air flow sensor 10 measures the air flow of fresh air supplied to intake manifold 6 and generates a signal LM as a function thereof. Lambda sensor 11 measures the oxygen content of the exhaust gas in exhaust pipe 7 and generates a signal $\lambda$ as a function thereof.

A throttle valve 12 whose rotational position can be adjusted by a signal DK is accommodated in intake manifold 6.

Throttle valve 12 is opened wide in a first operating mode, stratified charge operation of internal combustion engine 1. Fuel is injected by injection valve 8 into combustion chamber 4 during a compression phase produced by piston 2, namely with regard to space, it is injected into the immediate vicinity of sparkplug 9, and with regard to time, it is injected at a suitable interval before the firing time. Then the fuel is ignited with the help of sparkplug 9, so that piston 2 is driven by the expansion of the ignited fuel in the subsequent power stroke.

In a second operating mode, homogeneous operation of internal combustion engine 1, throttle valve 12 is partially opened or closed as a function of the desired air flow supplied. Fuel is injected by injection valve 8 into combustion chamber 4 during an intake phase produced by piston 2. Turbulence is created in the injected fuel by the simultaneous air intake and thus fuel is distributed essentially uniformly in combustion chamber 4. Then the fuel/air mixture is compressed during the compression phase and then ignited by sparkplug 9. Piston 2 is driven by the expansion of the ignited fuel.

In stratified charge operation as well as in homogeneous operation, a rotational motion is induced in crankshaft 14 by the driven piston, ultimately driving the wheels of the vehicle. Crankshaft 14 has an rpm sensor 15 which generates a signal N as a function of the rotational motion of crankshaft 14.

The fuel mass injected by injection valve 8 into combustion chamber 4 during stratified charge operation and homogeneous operation is controlled and/or regulated by a control unit 16 in particular with regard to low fuel consumption and/or low harmful emissions. To this end, control unit 16 has a microprocessor, having a program stored in a storage medium, in particular a read-only memory, suitable for executing the above-mentioned control and/or regulation.

Control unit 16 receives input signals representing performance quantities of the internal combustion engine measured by sensors. For example, control unit 16 is connected to air flow sensor 10, lambda sensor 11 and rpm sensor 15. In addition, control unit 16 is connected to a gas pedal sensor 17 which generates a signal FP indicating the position of a gas pedal operated by a driver and thus the torque demanded by the driver. Control unit 16 generates output signals with which the performance of the internal combustion engine can be influenced by actuators according to the desired control and/or regulation. For example, control unit 16 is connected to injection valve 8, sparkplug 9 and throttle valve 12 and generates signals TI, ZW and DK required to operate them.

Control unit 16 carries out the method of shifting from stratified charge operation to homogeneous operation as described below with reference to FIGS. 2 and 3. The blocks shown in FIG. 2 represent functions of the method which are implemented in control unit 16 in the form of software modules or the like, for example.

Figure 2:
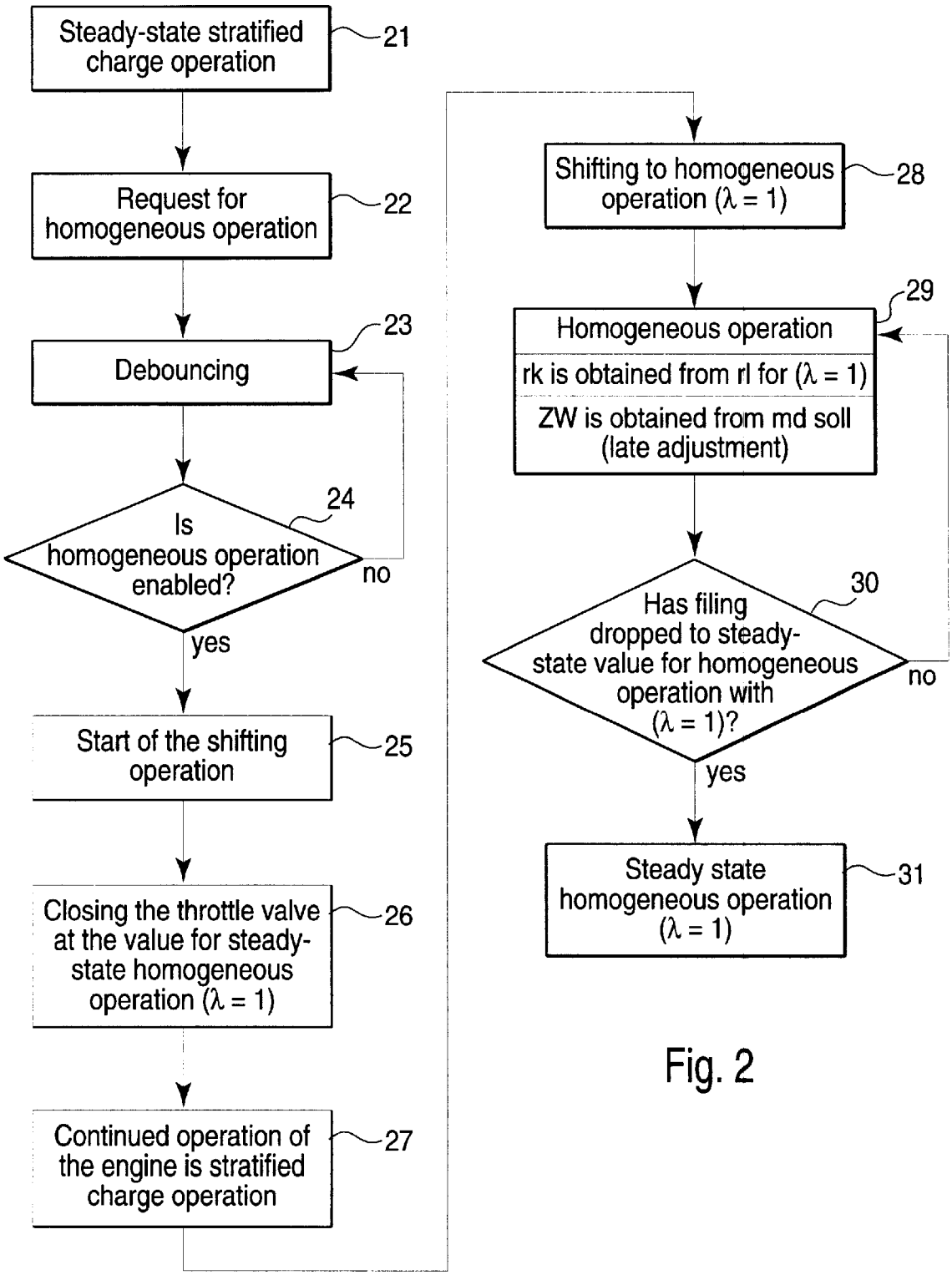
FIG. 2 shows a flow chart of the embodiment of a method according to the present invention for operating the internal combustion engine of FIG. 1.

As shown in FIG. 2, a block 21 starts with internal combustion engine 1 in steady-state stratified charge operation. Then in a block 22, a shift to homogeneous operation is requested because, for example, the driver desires to accelerate the vehicle. FIG. 3 also shows the time when homogeneous operation is requested.

Then debouncing is performed by blocks 23, 24 to prevent shifting back and forth in rapid succession between stratified charge operation and homogeneous operation. When homogeneous operation is enabled, the shift from stratified charge operation to homogeneous operation is started by a block 25. The time when the shifting operation begins is indicated by reference number 40 shown in FIG. 3.

At the stated time 40, throttle valve 12 is controlled by a block 26 from its completely opened state wdksch in stratified charge operation to an at least partially opened or closed state wdkhom for homogeneous operation. The rotational position of throttle valve 12 in homogeneous operation is based on a stoichiometric fuel/air mixture, i.e., on $\lambda=1$, and also depends on, for example, the desired torque and/or rpm N of internal combustion engine 1 and the like.

Due to the adjustment of throttle valve 12, internal combustion engine 1 changes from steady-state stratified charge operation to non-steady-state stratified charge operation. In this operating state, the air flow supplied to combustion chamber 4 drops gradually from a filling rlsch during stratified charge operation to a lower filling. This is shown in FIG. 3. Air flow r1 supplied to combustion chamber 4 or the filling of the latter is determined by control unit 16, inter alia, from signal LM of air flow sensor 10. According to a block 27, operation of internal combustion engine 1 in stratified charge operation is continued.

Then the engine is shifted to non-steady-state homogeneous operation by a block 28 in FIG. 2. This is the case at time 41 in FIG. 3.

According to a block 29, fuel mass rk injected into combustion chamber 4 in homogeneous operation is controlled and/or regulated as a function of air flow rl supplied to combustion chamber 4 to yield a stoichiometric fuel/air mixture, i.e., so that $\lambda=1$.

Fuel mass rk influenced in this way would result in an increase in torque Md delivered by internal combustion engine 1—at least for a certain period of time. This is compensated by adjusting firing angle ZW, starting from value zwsch, at time 41, i.e., with the shift to homogeneous operation, so that torque Md delivered maintains a setpoint torque mdsoll derived from the requested torque, among other things, and it thus remains approximately constant.

To this end, fuel mass rk is determined from air flow rl supplied to combustion chamber 4 on the basis of a stoichiometric fuel/air mixture. In addition, firing angle ZW is adjusted in the direction of late firing as a function of setpoint torque mdsoll. Thus, with regard to this late adjustment, there is a certain deviation from the normal homogeneous operation with which the excess air flow supplied and the resulting excess torque of internal combustion engine 1 are destroyed temporarily.

In a block 30, a check is performed to determine whether air flow rl supplied to combustion chamber 4 has ultimately dropped to the filling level which belongs to steady-state homogeneous operation at a stoichiometric fuel/air mixture. If this is not yet the case, the system continues to wait in a loop over block 29. However, if this is the case, internal combustion engine 1 is operated further in steady-state homogeneous operation by block 31 without a firing angle adjustment. This is the case at the time labeled with reference number 42 shown in FIG. 3.

In this steady-state homogeneous operation, the air flow supplied to combustion chamber 4 corresponds to filling rlhom for homogeneous operation, and firing angle zwhom for sparkplug 9 also corresponds to that for homogeneous operation. The same is also true of rotational position wdkhom of throttle valve 12.

Figure 3:
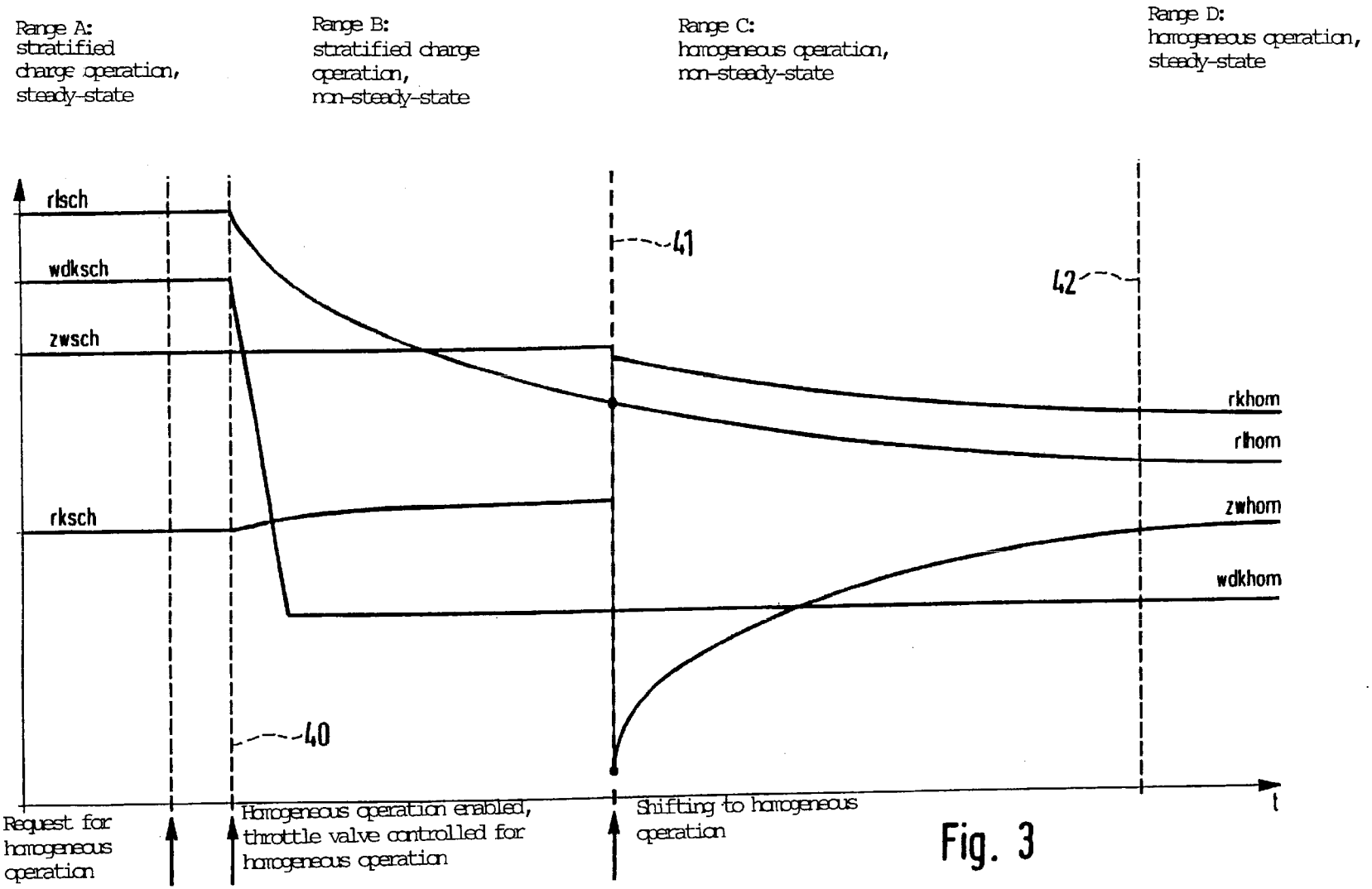
FIG. 3 shows a time chart of signals of the internal combustion engine of FIG. 1 in carrying out the method of FIG. 2.

As shown in FIG. 3, steady-state stratified charge operation is labeled as range A, non-steady-state stratified charge operation is labeled as range B, non-steady-state homogeneous operation as range C and steady-state homogeneous operation as range D.

Figure 4:
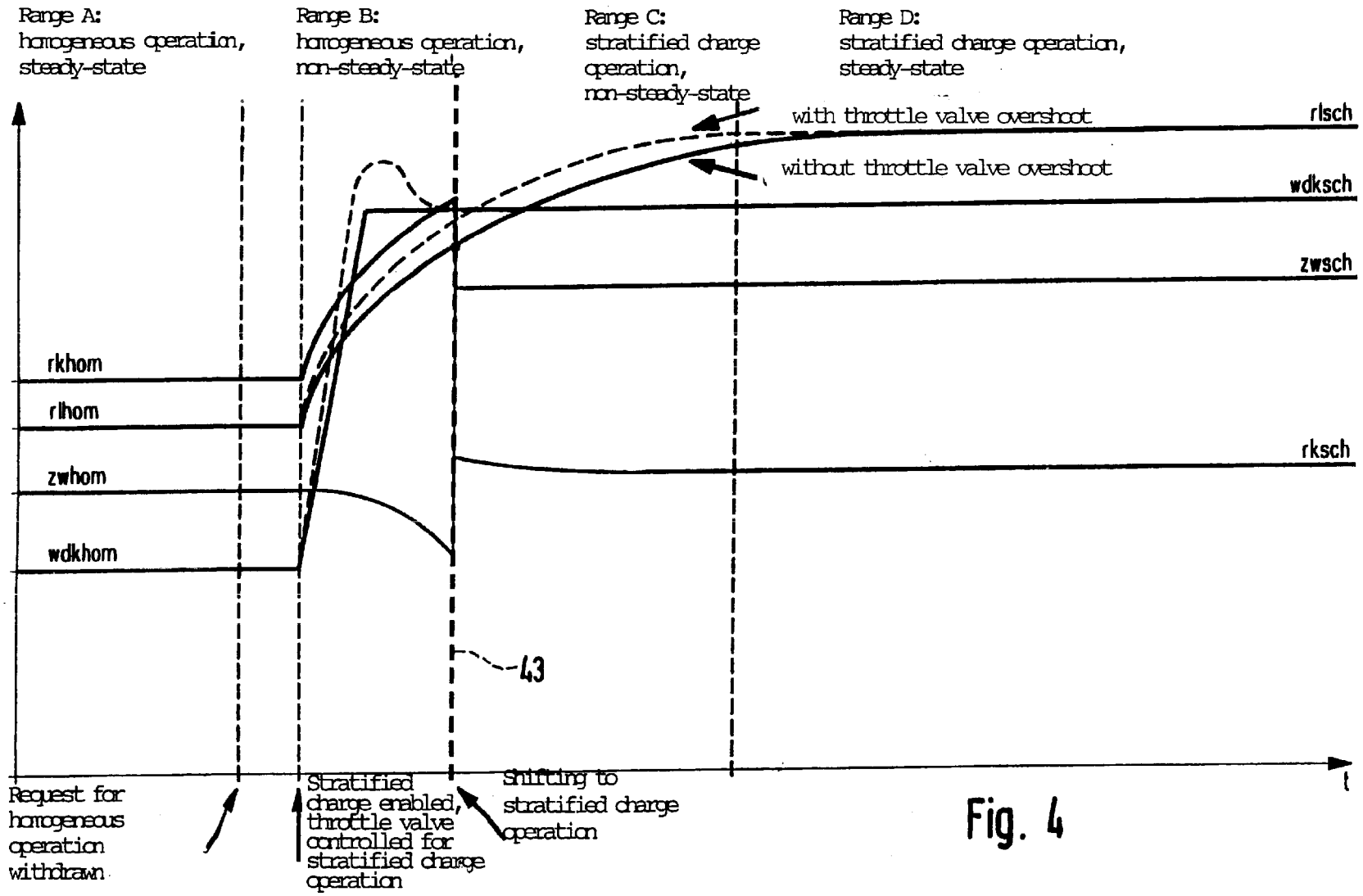
FIG. 4 shows a time chart of signals of the internal combustion engine of FIG. 1 in carrying out a method in opposition to the method of FIG. 2.

FIG. 4 illustrates shifting from a homogeneous operation to a stratified charge operation. Starting from a steady-state homogeneous operation, internal combustion engine 1 is to be shifted to steady-state stratified charge operation on the basis of the performance quantities, for example.

Shifting to stratified charge operation is initiated by control unit 16 by withdrawing the request for homogeneous operation. After debouncing, the shift to stratified charge operation is enabled and throttle valve 12 is controlled into the rotational position intended for stratified charge operation. This is a rotational position in which throttle valve 12 is mostly open. This is represented by the shift from wdkhom to wdksch shown in FIG. 4.

It is possible here for this shift to be processed further by control unit 16 with or without taking into account a throttle valve overshoot. This is represented by solid or dotted lines shown FIG. 4.

Opening throttle valve 12 results in an increase in air flow rl supplied to combustion chamber 4. This is shown by the shape of the rlhom curve shown in FIG. 4. Then there is a shift from the non-steady-state homogeneous operation described here to non-steady-state stratified charge operation. This is the case at time 43 shown in FIG. 4.

Before shifting to stratified charge operation, the increasing air flow supplied to combustion chamber 4 is compensated by an increase in injected fuel mass rk and a late adjustment of firing angle ZW. This is shown by the rkhom and zwhom curves shown in FIG. 4.

After shifting to stratified charge operation, injected fuel mass rk is set at value rksch for stratified charge operation. Likewise for firing angle ZW, which is set at value zwsch for stratified charge operation.

As shown in FIG. 4, steady-state homogeneous operation is labeled as range A, non-steady-state homogeneous operation as range B, non-steady-state stratified charge operation as range C and steady-state stratified charge operation as range D.

Figure 5A:
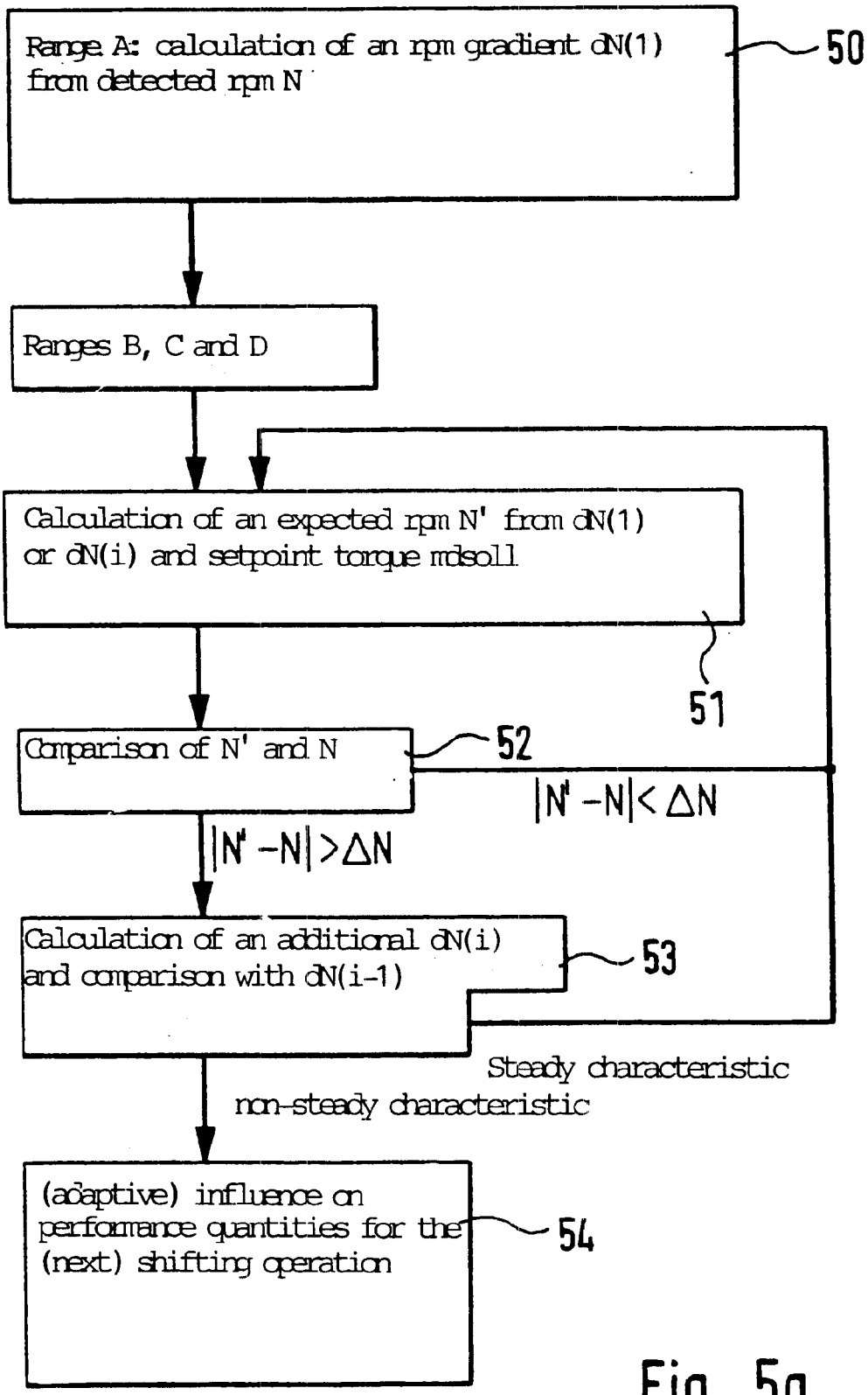
FIG. 5*a* shows a flow chart of a first embodiment of the method according to the present invention for shifting according to FIGS. 2 through 4.

FIG. 5*a* illustrates a first method which can be used during the operation of shifting from stratified charge operation to homogeneous operation according to FIGS. 2 and 3 or vice versa according to FIG. 4. This method is used to detect changes in torque of internal combustion engine 1, i.e., changes in actual torque Md delivered during the shifting operation. The blocks shown in FIG. 5*a* represent functions of the method implemented in the form of software modules or the like in control unit 16, for example.

In range A shown in FIGS. 3 and 4, a first rpm gradient dN(1) is calculated by control unit 16 in a block 50 from rpm N of internal combustion engine 1 detected at two successive times.

Then in successive ranges B, C and D shown in FIGS. 3 and 4, an expected rpm N' is calculated by control unit 16 at least once, optionally several times, in a block 51 as a function of first rpm gradient dN(1) or additional rpm gradients dN(i) and setpoint torque mdsoll, where setpoint torque mdsoll depends on, among other things, the torque demanded by the driver of internal combustion engine 1 by way of gas pedal 17. This expected rpm N' is compared in a block 52 with detected rpm N of internal combustion engine 1.

If the difference is less than an allowed rpm difference_N, i.e., if the absolute value is N'−N<_N, then a minor change in rpm of internal combustion engine 1 is deduced. At the same time, this means that internal combustion engine 1 does not exhibit any jerking or the like during the shifting operation. No additional measures are taken.

If the difference is greater than the allowed rpm difference_N, i.e., the absolute value is N'−N>_N, then a change in torque is deduced, representing or resulting in jerking of internal combustion engine 1. Thus, in this case, irregular running or jerking during the shifting operation is deduced from the fact that the allowed rpm difference_N has been exceeded.

Then in a block 53, another rpm gradient dN(i) is calculated from the last two detected rpm values N of internal combustion engine 1 and is compared with the last calculated rpm gradient dN(i−1). If this yields an approximately steady characteristic of the rpm gradients, it is concluded from this that the change in torque thus found is based on a change in load, i.e., it is a result of an inclination, for example, and thus there is no jerking and no irregular running. Therefore, no additional measures are taken.

However, if this yields a non-steady characteristic of the calculated rpm gradients, this is interpreted as confirmation of irregular running and the like during the shifting operation. In a block 54, this results in countermeasures which should counteract jerking and/or irregular running and will be explained below.

Figure 5B:
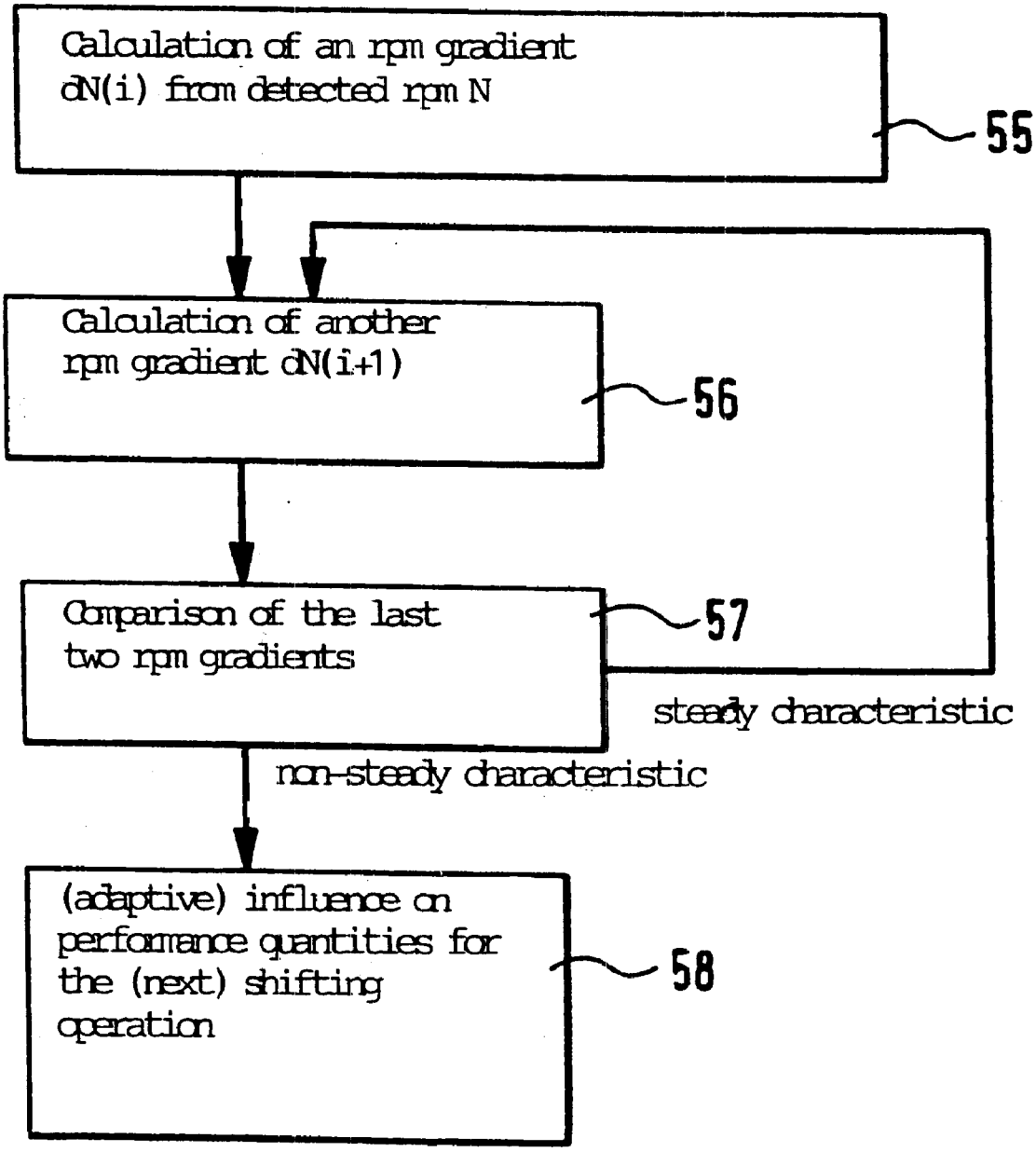
FIG. 5*b* shows a flow chart of a second embodiment of the method according to the present invention for shifting.

FIG. 5*b* illustrates a second method which can be used during the operation of shifting from stratified charge operation to homogeneous operation illustrated in FIGS. 2 and 3 or vice versa according to FIG. 4. This method is used to detect changes in torque of internal combustion engine 1, i.e., changes in actual torque Md during the shifting operation. The blocks shown in FIG. 5*b* represent functions of the method which are implemented, for example, in the form of software modules or the like in control unit 16.

In each of the ranges A, B, C and D shown in FIGS. 3 and 4, at least two rpm values N of internal combustion engine 1 are detected at successive times in blocks 55, 56 and then used by control unit 16 to calculate an rpm gradient dN(i). Two rpm gradients dN(i) and dN(i+1) calculated in succession are compared in a block 57. If this yields an approximately steady characteristic of the rpm gradients, it is concluded from this that there is no change in torque or that there are only torque changes based on load changes and resulting from a change in driving resistance, for example, and thus there is no jerking and no irregular running. Therefore, no additional measures are taken.

However, if the calculated rpm gradients yield a non-steady characteristic, jerking or irregular running and the like during the shifting operation are deduced. In a block 58 this results in countermeasures which should counteract jerking and irregular running and will be explained in greater detail below.

If changes in actual torque Md of internal combustion engine 1 are detected during the shifting operation according to one of the methods in FIG. 5*a* or 5*b*, countermeasures are initiated in blocks 54 and 58. These countermeasures involve changes in the performance quantities of internal combustion engine 1 for influencing actual torque Md of internal combustion engine 1.

In the operation of shifting from stratified charge operation to homogeneous operation illustrated in FIGS. 2 and 3, no changes in performance quantities of internal combustion engine 1 are implemented in range A.

When changes in torque are detected in range B, fuel mass rk to be injected into combustion chamber 4 is reduced or increased in such a way that reduces the changes in torque detected. When changes in torque are detected in range C, firing angle ZW or the firing time are adjusted in the late direction to compensate for excess filling rl of combustion chamber 4 and thus reduce the changes in torque. When changes in torque are detected in ranges B and C, these are dynamic changes in torque which can be corrected permanently by adaptive changes in the respective performance quantities.

When changes in torque are detected in range D, these are static changes in torque which can be compensated by a corresponding adaptive influence on fuel mass rk to be injected into combustion chamber 4 in stratified charge operation or by an influence on air flow rl and fuel rk to be adjusted during homogeneous operation.

In the operation of shifting from homogeneous operation to stratified charge operation illustrated in FIG. 4, no changes in the performance quantities of internal combustion engine 1 are made in range A.

When changes in torque are detected in range B, firing angle ZW or the firing time is adjusted in the late direction so that excess filling rl of combustion chamber 4 is compensated and thus the changes in torque are reduced. When changes in torque are detected in range C, fuel mass rk to be injected into combustion chamber 4 is increased or decreased to reduce the changes in torque detected. When changes in torque are detected in ranges B and C, these are dynamic changes in torque that can be corrected permanently by adaptive changes in the respective performance quantities.

When changes in torque are detected in range D, these are static changes in torque that can be compensated by an appropriate adaptive influence on, for example, fuel mass rk to be injected into combustion chamber 4 during stratified charge operation.

The above-mentioned influences on performance quantities of internal combustion engine 1 for compensation of irregular running or jerking during a shifting operation can be implemented immediately so that there is optionally even an effect during the instantaneous shifting operation. However, it is also possible for the influences to be implemented in such a way that an effect is not manifested until the next shifting operation.

What is claimed is:

1. A method for operating an internal combustion engine, comprising the steps of:

injecting a fuel directly into a combustion chamber of the internal combustion engine during one of:
a compression phase in a first operating mode, and
an intake phase in a second operating mode;

shifting between the first operating mode and the second operating mode;

controlling performance quantities of the internal combustion engine in a differentiated manner as a function of a setpoint torque in the first and second operating modes, the performance quantities influencing an actual torque of the internal combustion engine;

during the shifting step, determining a change in the actual torque; and influencing at least one of the performance quantities as a function of the change.

2. The method according to claim 1, further comprising the step of:

detecting a revolution-per-minute ("rpm") of the internal combustion engine, wherein the change in the actual torque is determined as a function of the detected rpm.

3. The method according to claim 2, further comprising the step of:

determining an expected rpm as a function of the setpoint torque; and comparing the expected rpm with the detected rpm.

4. The method according to claim 3, wherein the at least one of the performance quantities is influenced when the detected rpm differs from the expected value by more than a preselectable rpm difference.

5. The method according to claim 4, wherein the at least one of the performance quantities is not influenced when successive rpm differences have an approximately steady characteristic.

6. The method according to claim 2, further comprising the steps of:

determining at least two rpm gradients using the detected rpm; and comparing one of the rpm gradients with another one of the rpm gradients.

7. The method according to claim 6, wherein the at least one of the performance quantities is influenced when two of the rpm gradients have a non-steady characteristic.

8. The method according to claim 1, wherein one of the performance quantities is adaptively influenced.

9. The method according to claim 1, wherein one of the performance quantities is not influenced until a next shifting operation.

10. The method according to claim 1, wherein the performance quantities include an injected fuel mass, and wherein the injected fuel mass is increased in the first operating mode.

11. The method according to claim 1, wherein the performance quantities include one a firing angle and a firing time, one of the firing angle and the firing time being adjusted in the second operating mode, the second operating mode being after the first operating mode.

12. The method according to claim 1, wherein the internal combustion engine is provided in a motor vehicle.

13. A control element for a control unit of an internal combustion engine in a motor vehicle, comprising:

a storage arrangement storing a program which is executable on a computer, the program capable of performing the steps of:

injecting a fuel directly into a combustion chamber of the internal combustion engine du ring one of:
a compression phase in a first operating mode, and
an intake phase in a second operating mode, shifting between the first operating mode and the second operating mode, controlling performance quantities of the internal combustion engine in a differentiated manner as a function of a setpoint torque in the first and second operating modes, the performance quantities influencing an actual torque of the internal combustion engine, during the shifting step, determining a change in the actual torque, and influencing at least one of the performance quantities as a function of the change.

14. The control element according to claim 13, wherein the computer includes a microprocessor.

15. The control element according to claim 13, wherein the storage arrangement includes a read-only memory device.

16. An internal combustion engine, comprising:

combustion chamber;

an injection valve for directly injecting a fuel into the combustion chamber during one of:
a compression phase in a first operating mode, and
an intake phase in a second operating mode; and a control unit executing a shifting operation to shift between the first operating mode and the second operating mode, the control unit controlling performance quantities of the internal combustion engine in a differentiated manner as a function of a setpoint torque in the first and second operating modes, the performance quantities influencing an actual torque of the internal combustion engine, wherein the control unit determines a change in the actual torque during the shifting operation, and wherein the control unit influences at least one of the performance quantities as a function of the change.

17. The internal combustion engine according to claim 16, wherein the internal combustion engine is provided for a motor vehicle.

* * * * *

UNITED STATES PATENT AND TRADEMARK OFFICE

CERTIFICATE OF CORRECTION

PATENT NO. : 6,539,914 B1
DATED : April 1, 2003
INVENTOR(S) : Winfried Moser et al.

It is certified that error appears in the above-identified patent and that said Letters Patent is hereby corrected as shown below:

Column 3,
Line 61, change “maybe” to -- may be --.

Column 4,
Line 23, insert “Detailed Description”.

Signed and Sealed this

Twenty-seventh Day of April, 2004

JON W. DUDAS
*Acting Director of the United States Patent and Trademark Office*

UNITED STATES PATENT AND TRADEMARK OFFICE

CERTIFICATE OF CORRECTION

PATENT NO. : 6,539,914 B1
DATED : April 1, 2003
INVENTOR(S) : Winfried Moser et al.

It is certified that error appears in the above-identified patent and that said Letters Patent is hereby corrected as shown below:

Column 3,
Line 41, change “advantageous refinement” to -- embodiment --.

Signed and Sealed this

Twenty-fourth Day of May, 2005

JON W. DUDAS
*Director of the United States Patent and Trademark Office*